United States Patent [19]

Eglais

[11] Patent Number: 4,598,658

[45] Date of Patent: Jul. 8, 1986

[54] ARRANGEMENT FOR CONTROLLING THE SPINNAKER OF A SAIL CATAMARAN

[75] Inventor: Aldis O. Eglais, Riga, U.S.S.R.

[73] Assignee: Tsarnikavsky Rybolovetsky Kolkhoz "Tsarnikava", Latviiskaya, U.S.S.R.

[21] Appl. No.: 683,272

[22] PCT Filed: Mar. 7, 1984

[86] PCT No.: PCT/SU84/00010

§ 371 Date: Nov. 27, 1984

§ 102(e) Date: Nov. 27, 1984

[87] PCT Pub. No.: WO84/04079

PCT Pub. Date: Oct. 25, 1984

[30] Foreign Application Priority Data

Dec. 4, 1983 [SU] U.S.S.R. ..... 3578245

[51] Int. Cl.[4] ..... B63H 9/04

[52] U.S. Cl. ..... 114/39; 114/98; 114/102; 114/61

[58] Field of Search ..... 114/39.1, 102, 97, 98, 114/103, 61, 111, 105, 106, 89, 90

[56] References Cited

U.S. PATENT DOCUMENTS

| | | | |
|---|---|---|---|
| 795,025 | 7/1905 | Collins | 114/98 |
| 3,157,149 | 11/1964 | Manchester | 114/39.1 |
| 3,185,121 | 5/1965 | Nilsen | 114/102 |
| 3,207,114 | 9/1965 | Moseley | 114/102 |
| 3,438,349 | 4/1969 | Curtis et al. | 114/102 |
| 3,464,379 | 9/1969 | Lawson | 114/102 |
| 4,022,144 | 5/1977 | Gitchel | 114/104 |
| 4,102,289 | 7/1978 | Ebbeson | 114/104 |
| 4,108,100 | 8/1978 | Jamieson | 114/39.1 |
| 4,164,193 | 8/1979 | Smith | 114/111 |
| 4,292,910 | 10/1981 | Hoyt | 114/102 |
| 4,345,535 | 8/1982 | Ross | 114/39.1 |

OTHER PUBLICATIONS

"Boats and Yachts", No. 4 (6A), 1977, pp. 41, 51 and 84, Sudostroenye Publishing House.

*Primary Examiner*—Trygve M. Blix
*Assistant Examiner*—Edwin L. Swinehart
*Attorney, Agent, or Firm*—Lilling & Greenspan

[57] ABSTRACT

An arrangement for controlling a spinnaker of a sail catamaran having two hulls joined by beams, comprising a spinnaker boom to whose front end spinnaker and one end of a halyard are secured, the other end of the halyard being secured to a mast. Lower stays are each secured by one end to the front end of the spinnaker boom and by their other ends to respective stoppers. On the front beam joining the hulls there is provided an upright, and the spinnaker boom is hinged to the upper end of the upright. There are also provided two stays, each having one end secured to the upper end of the upright and the other end secured to the bow of a respective hull.

2 Claims, 2 Drawing Figures

ARRANGEMENT FOR CONTROLLING THE SPINNAKER OF A SAIL CATAMARAN

FIELD OF THE INVENTION

The present invention relates to sail boats and, more particularly, to arrangements used for controlling the spinnaker of sail catamarans.

DESCRIPTION OF THE PRIOR ART

Known in the art is an arrangement for controlling the spinnaker of a sail catamaran, comprising a spinnaker boom which is hinged by its one end portion to the mast, the hinge allowing for a free turn of the spinnaker boom both in the vertical and horizontal planes. Fastened to the spinnaker boom by one end is its halyard whose other end is passed through a block on the mast and is brought out to a stopper. Also fastened to the spinnaker boom is a lower stay whose free end is brought out to its stopper disposed near the mast lower end portion. The spinnaker is secured by its tack to the front (free) end of the spinnaker boom. The brace and the sheet of the spinnaker are each brought out to its stopper. (cf. "Boats and Yachts", No. 4 (68), 1977, pp. 41, 51 and 84, "Sudostroenye" Publishing House).

In order to provide for the required stagger of the tack of the spinnaker, the spinnaker boom in the above arrangement is made of a relatively great length, which results in an increased total weight of the catamaran and a higher cost of manufacture. Besides, during tacking the spinnaker boom of this type has to be disconnected from the mast and passed through under the forestay, and, with the spinnaker furled, the spinnaker has to be removed so that it would not interfere with the operation of the other front sails. All this consumes a considerable amount of time required for setting and furling the spinnaker.

SUMMARY OF THE INVENTION

The present invention has as one of its purposes the provision of an arrangement for controlling the spinnaker of a sail catamaran, in which the spinnaker boom would be mounted on the catamaran in such a manner that it would make it possible to decrease the weight and cost of fabrication of the catamaran, as well as to reduce the time necessary for setting and furling the spinnaker.

The above task is accomplished by an arrangement for controlling the spinnaker of a sailboat having two hulls joined by beams, comprising a spinnaker boom having the spinnaker and one end of the halyard fastened to the front end thereof, the other end of the halyard being fastened to the mast, and a lower stay secured by one end to the front end of the spinnaker boom and by its other end to a stopper. According to the invention, the front beam joining the hulls supports an upright, the spinnaker boom is hinged to the upper end of the upright, and provision is made of two stays of which each is secured by one end to the upper end of the upright and by its other end to the bow of a respective hull.

It is feasible to provide the arrangement with an additional lower stay which would be fastened by one end to the front end of the spinnaker boom and by its other end to its stopper, each lower stay being brought out to its stopper via a block secured to the bow of a respective hull of the catamaran.

This constructive embodiment makes it possible to substitute on the spinnaker boom the spinnaker with the foresail and to comfortably control the position of its tack.

It is possible to mount a block on the free end of the spinnaker boom, to pass the end of the halyard through the block and to secure it to the stopper mounted on the spinnaker boom.

This constructive embodiment allows a decrease in the total length of the halyard and, consequently, the air resistance.

The arrangement for controlling the spinnaker of a sail catamaran, built in accordance with the present invention, makes it possible to decrease the weight and the cost of fabrication of the catamaran owing to a smaller length of the spinnaker boom. Besides, the arrangement allows a reduction of the time required for setting and furling the spinnaker and to make it easier to change the tack.

BRIEF DESCRIPTION OF THE DRAWINGS

The following description of a specific embodiment of the present invention is given with reference to the accompanying drawings, in which.

DETAILED DESCRIPTION OF THE INVENTION

Figure 2:
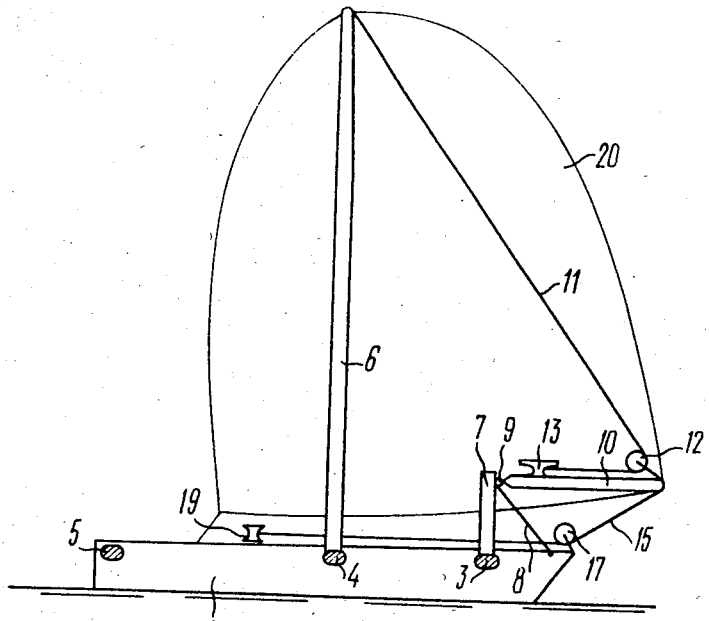
FIG. 2 is a cross sectional view taken along lines II—II of FIG. 1.
Figure 1:
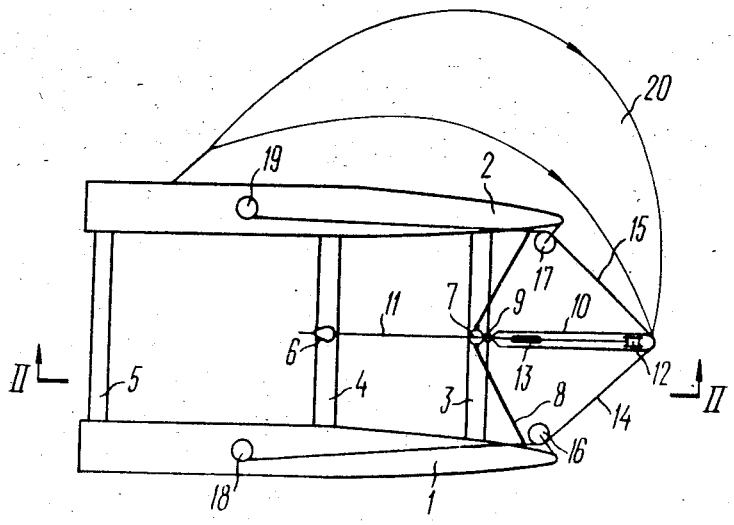
FIG. 1 is a top view of the catamaran, according to the invention.

The arrangement for controlling the spinnaker is mounted on a catamaran formed by two hulls 1 (FIG. 1) and 2 joined by beams 3, 4 and 5, the medium beam mounting mast 6 (FIGS. 1,2) supported by a standing rigging which is not conventionally shown in FIGS. 1 and 2. The front beam 3 supports an upright 7 having two stays 8 (steel cables) secured to the upper end thereof, the other ends of the stays 8 being secured to the bows of the respective hulls 1 and 2. Secured to the upper end of the upright 7 by means of a hinge 9 is a spinnaker boom 10, the hinge 9 providing for turning of the spinnaker boom both in the vertical and horizontal planes. Fastened to the upper end of the mast 6 (the mast head) is an end of a halyard 11 whose other end is passed through a block 12 mounted on the free end of the spinnaker boom 10 and is further brought out to a stopper 13 mounted on the spinnaker boom 10. Secured to the free end of the spinnaker boom 10 are a lower stay 14 and an additional lower stay 15 hereinafter referred to as lower stays. Each of the lower stays 14 and 15 is passed through a respective block 16 (FIG. 1), 17 mounted on the bow of the respective hull 1 or 2. The free ends of the lower stays 14, 15 are secured to stoppers 18, 19 which are mounted on the hull 1, 2, respectively. The stoppers 13, 18, 19 can be also disposed in any other place which is convenient for controlling the spinnaker.

Secured its tack to the free end of the spinnaker boom 10 is a spinnaker 20. As to fastening of the clew and halyard point of the spinnaker 20, they can be fastened by any conventional means suitable for the purpose, and, therefore, are neither described, nor conventionally shown in FIGS. 1, 2.

The arrangement for controlling the spinnaker of a sail catamaran functions as follows.

During the setting of the spinnaker 20, by letting one of the lower stays 14 (15) and hauling the other one 15

(14) the spinnaker boom 10 is brought in such a position that its free end is disposed above the bow of one of the hulls 1 or 2, the required height of the spinnaker boom 10 being set by means of the halyard 11. The tack of the spinnaker 20 is fastened to the free end of the spinnaker boom 10, whereas fastening of the clew and halyard point of the spinnaker and lifting of the latter are effected by any conventional methods.

Thereupon, depending on the wind direction, by means of the lower stays 14 (15) and by turning the spinnaker boom 10, the tack of the spinnaker 20 is set in the required position in the horizontal and vertical planes. In case the wind pressure acting on the spinnaker 20 is not sufficient to pull tight both lower stays 14, 15, the lower end of the halyard 11 is hauled in and is fixed in the stopper 13.

Tacking, when, due to a change in the course of the boat the wind direction relative to the boat changes, and it starts blowing from the opposite side, is performed in the following order.

The catamaran changes its course straight along the wind direction. The spinnaker 20 is set straight in front of the boat and symmetrically with respect to the boat center line and is held in this position by means of a sheet and brace (the equipment secured to the tack of the spinnaker). The free end of the spinnaker boom 10 is disconnected from the tack of the spinnaker 20, and the spinnaker boom 10 is brought by means of the lower stays 14 and 15 to the opposite board, and the opposite lower corner of the spinnaker 20 is secured to its free end. (Upon tackling, the denominations of the lower corners of the spinnaker, i.e. the tack and the clew, and the denominations of the equipment secured thereto, i.e. the brace and the sheet, are changed to the opposite ones).

Setting on the spinnaker boom 10 of a foresail (not shown in the drawing) instead of the spinnaker 20 is carried out by the afore-described method, except that the luff (the front side) of the foresail may be left either free, or be secured to the halyard 11 by any conventional method.

Control of the position of the tack of the foresail is analogous to the afore-described control of the spinnaker 20.

A change of the tack of the foresail mounted on the spinnaker boom 10 is similar to a change of the tack of the foresail set by a conventional method.

As the arrangement for controlling the spinnaker of a sail catamaran is positioned in front of the beating sails, i.e. in front of the forestay (not shown in the drawing), the spinnaker boom 10 does not interfere with the operations of the sails, and, with the spinnaker 20 furled, it is not necessary to take away the spinnaker boom 10. When in its non-operating position, the spinnaker boom 10 can be laid horizontally in the longitudinal direction so that it meets the minimal air resistance during the catamaran movement. The free end of the spinnaker boom 10 may also be moved aside, lifted or lowered so that it does not extend outside the boat.

The arrangement for controlling the spinnaker of a sail catamaran, according to the present invention, makes it possible to reduce considerably the length and diameter of the spinnaker boom, which results in its lower weight and cost of manufacture. At the same time, the forward extension of the tack of the spinnaker is even increased, which is particularly important for fast-going catamarans when they are not sailing under pure flydown wind.

The arrangement of the present invention makes it unnecessary to disconnect the spinnaker boom from the point of its mounting both during furling of the spinnaker and tacking. It is no longer necessary to store the spinnaker boom on the boat deck where it interferes with the operations with the sails.

The spinnaker boom of the present invention, which has two lower stays brought out to the bows of the both hulls, allows to apply to its free end much greater loads and to carry efficiently an additional foresail with a tightly pulled luff. This allows, with a present height of the rigging, to increase considerably the area of the sails and, consequently, to improve the sea performance of the catamaran.

I claim:

1. An arrangement for controlling the spinnaker of a sail catamaran consisting of two hulls joined by beams and having a mast on one of said beams, comprising a spinnaker boom having a spinnaker, an end of a halyard and lower stays secured to the front end of said spinnaker boom, the other end of the halyard being secured to the mast and the lower stays being secured by one end to the end of the spinnaker boom and by other ends to respective stoppers, wherein the improvement comprises an upright mounted on a front beam joining the hulls mounts an upright; the spinnaker boom being hinged to the upper end of the upright; and two stays, each of which is secured by one end to the upper end of the upright and by its other end to the bow of a respective hull of the catamaran.

2. An arrangement according to claim 1, further comprising a block mounted on the free end of the spinnaker boom, and the end of the halyard is passed through the block and is secured by its end to a stopper mounted on the spinnaker boom.

* * * * *